US009640293B2

(12) United States Patent
Roessl et al.

(10) Patent No.: US 9,640,293 B2
(45) Date of Patent: May 2, 2017

(54) TALBOT EFFECT BASED NEARFIELD DIFFRACTION FOR SPECTRAL FILTERING

(71) Applicant: KONINKLIJKE PHILIPS N.V., Eindhoven (NL)

(72) Inventors: Ewald Roessl, Henstedt-Ulzburg (DE); Thomas Koehler, Norderstedt (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/785,644

(22) PCT Filed: Nov. 12, 2014

(86) PCT No.: PCT/EP2014/074321

§ 371 (c)(1),
(2) Date: Oct. 20, 2015

(87) PCT Pub. No.: WO2015/078690

PCT Pub. Date: Jun. 4, 2015

(65) Prior Publication Data

US 2016/0260515 A1 Sep. 8, 2016

(30) Foreign Application Priority Data

Nov. 28, 2013 (EP) ..... 13194809
Apr. 7, 2014 (EP) ..... 14163668

(51) Int. Cl.
*G21K 1/06* (2006.01)

(52) U.S. Cl.
CPC ..... *G21K 1/065* (2013.01); *G21K 1/06* (2013.01); *G21K 2207/005* (2013.01)

(58) Field of Classification Search
CPC ..... A61B 6/484; G21K 1/06; G21K 1/067; G21K 2201/067; G01N 23/20008
See application file for complete search history.

(56) References Cited

U.S. PATENT DOCUMENTS 4,578,803 A 3/1986 Macovski
5,812,629 A 9/1998 Clauser
(Continued)

FOREIGN PATENT DOCUMENTS

EP 2080982 A1 7/2009
JP 2012187288 A 10/2012
(Continued)

OTHER PUBLICATIONS

Suzuki Yoshio et al, "Hard x-ray holographic microscopy using refractive prism and Fresnel zone plate objective", Review of Scientific Instruments, AIP, Melvile, NY, US, vol. 76, No. 9, Aug. 23, 2005, pp. 93702-093702, XP012079714, ISSN: 0034-6748.

*Primary Examiner* — Glen Kao

(57) ABSTRACT

The invention relates to a grating arrangement and a method for spectral filtering of an X-ray beam (B), the grating arrangement comprising: a dispersive element (10) comprising a prism configured to diffract the X-ray beam (B) into a first beam component (BC1) comprising a first direction (D1) and a second beam component comprising (BC2) a second direction (D2), tilted with respect to the first direction; a first grating (20) configured to generate a first diffraction pattern (DP1) of the first beam component (BC1) and a second diffraction pattern (DP2) of the second beam component (BC2), the second diffraction pattern (DP2) shifted with respect to the first diffraction patter (DP1); and a second grating (30) comprising at least one opening (31) which is aligned along a line (d) from a maximum (MA) to a minimum (MI) of intensity of the first diffraction pattern (DP1) or of the second diffraction pattern (DP2).

15 Claims, 7 Drawing Sheets

(56) References Cited

U.S. PATENT DOCUMENTS

| | | | | |
|---|---|---|---|---|
| 2007/0183562 | A1 | 8/2007 | Popescu | |
| 2007/0183583 | A1 | 8/2007 | Baumann | |
| 2011/0051889 | A1 | 3/2011 | Sato | |
| 2013/0028378 | A1 | 1/2013 | Stutman et al. | |
| 2013/0259194 | A1 | 10/2013 | Yik | |
| 2016/0066873 | A1* | 3/2016 | Preusche ..... | A61B 6/4035<br>378/36 |

FOREIGN PATENT DOCUMENTS

| | | | |
|---|---|---|---|
| WO | 2007125833 | A1 | 11/2007 |
| WO | 2009104560 | A1 | 8/2009 |

* cited by examiner

TALBOT EFFECT BASED NEARFIELD DIFFRACTION FOR SPECTRAL FILTERING

CROSS-REFERENCE TO PRIOR APPLICATIONS

This application is the U.S. National Phase application under 35 U.S.C. §371 of International Application No. PCT/EP2014/074321, filed on Nov. 12, 2014, which claims the benefit of European Patent Application No. 13194809.3, filed on Nov. 28, 2013 and European Patent Application No. 14163668.8, filed on Apr. 7, 2014. These applications are hereby incorporated by reference herein.

FIELD OF THE INVENTION

The invention relates to a grating arrangement and a method for spectral filtering of an X-ray beam.

BACKGROUND OF THE INVENTION

The Talbot effect in X-rays is made use of in differential phase contrast imaging in order to measure the lateral shifts of interference fringes caused by phase shifts in the X-ray field induced by gradients of the X-ray refractive index. The phase shift depends on energy such that the shift in phase of the X-ray wave at the monochromatic component corresponding to energy E by a small wedge is given by:

$$\Delta\Phi(E) = \Delta\Phi(E_0)\frac{E_0}{E}$$

where $\Delta\Phi(E_0)$ denotes the phase shift at the monochromatic component corresponding to energy $E_0$. This is in total analogy with the well-known dispersive effect of a prism in the optical band of frequencies which can be used to analyze the spectral content of light. In the visible domain around $5.0\cdot10^{14}$ Hz the refraction of light is sufficiently strong (water: n=1.33) to use the angular dispersion directly for singling out a given monochromatic component from a polychromatic spectrum using a single slit. In the X-ray domain the refractive index is much closer to one (and actually smaller than one), e.g. for X-rays with 30 keV of energy ($7.25\cdot10^{18}$ Hz), the refractive index is 0.9999997, leading to minute diffraction angles and related small dispersion effects.

U.S. Pat. No. 5,812,629 describes an apparatus and a method for radiography practice. The described apparatus operates via Talbot filters using two pre-objected microfabricated gratings.

US 2013/0028378 A1 describes a differential phase contrast X-ray imaging system including an X-ray illumination system, a beam splitter arranged in an system arranged in an optical path to detect X-rays after passing through the beam splitter.

WO 2007/125833 A1 describes an X-ray image picking-up device and its method for a continuous X-ray generation for picking up an image with a high sensitivity based on X-ray phase information.

WO 2009/104560 A1 describes an X-ray source enabling the omission of installation of multi-slits in a highly sensitive X-ray imaging method using an X-ray Talbot-Lau interferometer and an X-ray imaging apparatus using the X-ray source.

U.S. Pat. No. 4,578,803 describes an energy-selective X-ray imaging system, wherein images are produced using two scintillating screens separated by an X-ray hardening filter. In the described system, photosensitive surfaces individually receive the light images from each screen. For the case of the described energy-selective X-ray imaging system, the resultant image transparencies are read out optically using a partially reflecting mirror between the transparencies and detecting the reflected and transmitted light. The X-ray spectral separation between the two acquired images can be further increased by using an X-ray source filter of the described energy-selective X-ray imaging system, having a K-absorption edge in the vicinity of the region of overlap of the two spectra.

SUMMARY OF THE INVENTION

There may be a need to improve the accuracy of energy selective X-ray filters. There may be also a need for an improved performance of energy selective X-ray filters.

These needs are met by the subject-matter of the independent claims. Further exemplary embodiments are evident from the dependent claims and the following description.

An aspect of the invention relates to a grating arrangement for spectral filtering of an X-ray beam, comprising:

a dispersive element comprising a prism configured to diffract the X-ray beam into a first beam component comprising a first direction and a second beam component comprising a second direction tilted with respect to the first direction;

a first grating configured to generate a first diffraction pattern of the first beam component and a second diffraction pattern of the second beam component, the second diffraction pattern shifted with respect to the first diffraction patter; and a second grating comprising at least one opening which is aligned along a line from a maximum to a minimum of intensity of the first diffraction pattern or of the second diffraction pattern.

A further aspect of the invention relates to an X-ray system, with an X-ray source, which is adapted to generate a polychromatic spectrum of X-rays, a detector and at least one grating arrangement.

A further aspect of the invention relates to a method for spectral filtering of an X-ray beam, comprising the steps of:

diffracting the X-ray beam into a first beam component comprising a first direction and a second beam component comprising a second direction tilted with respect to the first direction by means of a dispersive element comprising a prism;

generating a first diffraction pattern of the first beam component and a second diffraction pattern of the second beam component by means of a first grating, the second diffraction pattern shifted with respect to the first diffraction pattern; and aligning a second grating with at least one opening in such way that the at least one opening is aligned along a line from a maximum to a minimum of an intensity of the first diffraction pattern or of the second diffraction pattern.

A further aspect of the invention relates to a computer program, which, when executed by a processor of an X-ray system according to the last but two aspect, causes the X-ray system to carry out the steps of the method according to the previous aspect.

The Talbot effect has the useful property that the frequency of interference fringes is independent of the wave-length of the radiation and depends only on a phase grating or absorption gratings and the divergence of the beam. Without an object in front of the phase gratings, the interference fringes corresponding to all quasi-monochromatic components in the primary spectrum will be generated at the same location, i.e. white-beam interferences will be observed. With the addition of a dispersive element into the X-ray beam, like a prims or similar, the interferences corresponding to different quasi-monochromatic components will we slightly shifted with respect to each other. Hence, the X-ray wave field at the location of the analyzer grating will be a complicated superposition of fringes corresponding to different energies but with the same frequency. Thus, it is possible to use a mask to select certain of the monochromatic components for transmission and others for attenuation by the analyzer/filter grating simply by stepping the grating, e. g. aligning least one opening along a line from a maximum to a minimum of intensity of the first diffraction pattern or of the second diffraction pattern.

The invention advantageously allows filtering the radiation, emitted by an X-ray source in form of a polychromatic spectrum, by means of a dispersive element, like an X-ray prism or a wedge and a Talbot-interferometer, comprising a phase grating and an analyzer grating. The transverse coherence requirements are such that one period of the phase grating may be illuminated by the source coherently. In case the transverse coherence of the source is insufficient, a source grating can be added to increase the transverse coherence of the source. An alternative is the increase of the source to phase-grating distance.

When the X-rays hit the prism, a small dispersion is created leading to an energy-dependent lateral shift of the interference pattern with respect to the case without a dispersive element. The larger the prism angle and the larger the refractive index of the prism material, i.e., the larger the phase shift between neighboring lateral locations in the wave, the wider the separation between corresponding maxima in the interference patterns of any two distinct quasi-monochromatic components. If now the analyzer grating is positioned in such a way that the first quasi-monochromatic component is blocked, while the second quasi-monochromatic component is transmitted by the grating, the system acts like an efficient energy selective filter.

According to an exemplary embodiment of the invention, the first direction and the second direction are tilted, spanning a tilt angle.

According to an exemplary embodiment of the invention, the first grating is configured to shift the second diffraction pattern with respect to the first diffraction pattern along a direction corresponding to the direction of the line.

According to an exemplary embodiment of the invention, the first grating and the second grating are placed almost parallel to each other. Almost parallel means that the first grating and the second grating are aligned in parallel with a deviation of less than 10° or less than 5° or less than 1°. Further, almost parallel may express that at least a certain area of the first grating and a certain area of the second grating are aligned in parallel.

According to an exemplary embodiment of the invention, the first beam component and/or the second beam component comprise quasi-monochromatic X-ray radiation.

According to an exemplary embodiment of the invention, the first grating is configured to generate the first diffraction pattern of the first beam component and the second diffraction pattern of the second beam component as a near-field diffraction effect. In other words, both diffraction patterns are based on a near-field diffraction effect.

According to an exemplary embodiment of the invention, the second diffraction pattern is shifted with respect to the first diffraction patter by means of an energy-dependent lateral shift.

According to an exemplary embodiment of the invention, the first grating and/or the second grating comprise a periodic structure.

According to an exemplary embodiment of the invention, the first grating and/or the second grating is configured to be movable in such way that the at least one opening is moveable along the line from the maximum to the minimum of intensity of the first diffraction pattern or of the second diffraction pattern.

According to an exemplary embodiment of the invention, the dispersive element and the first grating are integrated such as to constitute a dispersive grating. The dispersive grating, which jointly incorporates aforementioned dispersive element and first grating, is configured for diffracting the X-ray beam into the first beam component comprising the first direction and the second beam component comprising the second direction, wherein the second direction is being tilted with respect to the first direction, as well as for subsequently generating the first diffraction pattern of the first beam component and the second diffraction pattern of the second beam component, wherein the second diffraction pattern is being shifted with respect to the first diffraction pattern. Incorporating the dispersive element and the first grating into the dispersive grating has the effects of reducing with one the number of components for the grating arrangement. Therefore this embodiment is advantageous in making alignment requirements less stringent.

According to an exemplary embodiment of the invention, the dispersive element comprises a periodic structure of prisms, wherein each of said prisms is configured for diffracting the X-ray beam (B) into the first beam component (BC1) comprising a first direction (D1) and the second beam component comprising (BC2) the second direction (D2), and wherein said second direction is tilted with respect to the first direction. This embodiment is capable of reducing, proportional to the periodicity of the periodic structure of prisms, the height of the dispersive element without affecting its dispersive qualities. For example and without limitation, if the periodic structure comprises 2, 3, 4, 10 or 25 prisms, the height of the dispersive element is reduced with a factor 2, 3, 4, 10 or 25, respectively, compared to a dispersive element without such periodic structure. As a consequence this embodiment advantageously makes the grating arrangement more compact. Moreover, this embodiment has the advantage of reducing attenuation of the X-ray beam by the dispersive element.

According to an exemplary embodiment of the invention, the periodic structure of the dispersive element has a period Td, wherein the first grating has a period Tg, wherein the period Td equals the period Tg of the first grating if the first grating is a microlensing grating, and wherein the period Td equals half of the period Tg otherwise.

According to an exemplary embodiment of the invention, the first grating is a microlensing grating. In this text, a microlensing grating implies a grating in which the periodic structure of the grating is non-binary. An example of such non-binary periodic structure is a sequence of mutually contiguous elements from the range of triangular, semicircles or parabola shaped prisms. A microlensing grating will generate a non-rectangular amplitude modulation. Therefore, this embodiment is advantageous it enables the second grating to more effectively filter a range of energies rather than one dedicated energy.

BRIEF DESCRIPTION OF THE DRAWINGS

A more complete appreciation of the invention and the attendant advantages thereof will be more clearly understood by reference to the following schematic drawings, which are not to scale, wherein.

DETAILED DESCRIPTION OF EMBODIMENTS

Figure 1:
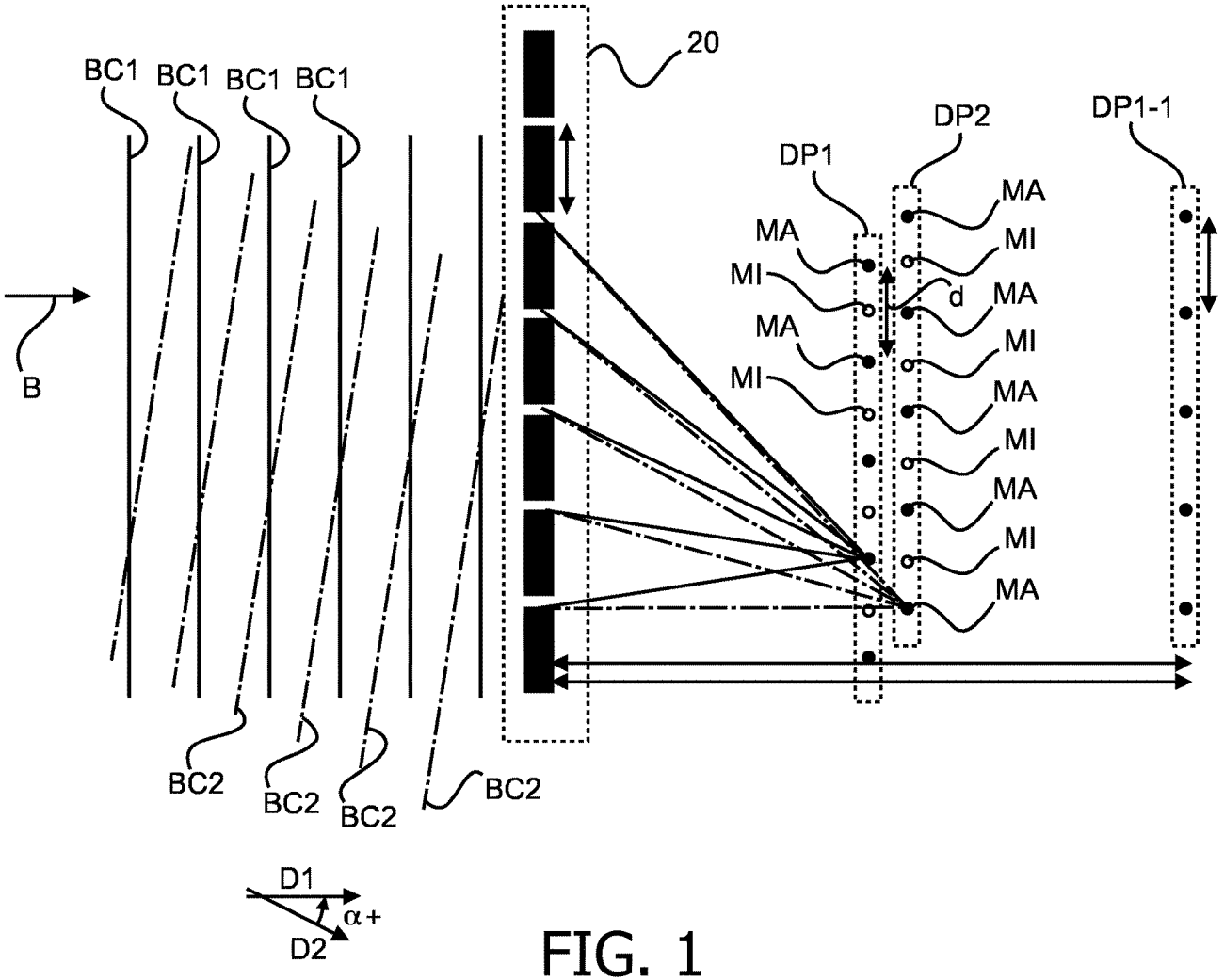
FIG. 1 shows a schematic diagram of a grating arrangement for spectral filtering of an X-ray beam according to an exemplary embodiment of the invention.

The illustration in the drawings is schematically and not to scale. In different drawings, similar or identical elements are provided with the same reference numerals. Generally, identical parts, units, entities or steps are provided with the same reference symbols in the figures.

Apparently, the described embodiments are only some embodiments of the present invention, rather than all embodiments. Based on the embodiments of the present invention, all other embodiments obtained by persons of ordinary skill in the art without making any creative effort shall fall within the protection scope of the present invention.

The grating arrangement for spectral filtering of an X-ray beam may be arranged in the beam path of an X-ray tube of a tomography system or of any other medical X-ray imaging system.

FIG. 1 shows a schematic diagram of a grating arrangement for spectral filtering of an X-ray beam according to an exemplary embodiment of the invention.

The Talbot effect is a near-field diffraction effect. When a plane wave is incident upon a periodic diffraction grating, the image of the grating is repeated at regular distances away from the grating plane.

A first grating 20 represents the periodic diffraction grating, in FIG. 1, two plane waves of the first beam component BC1 and the second beam component BC2 are visualized. The first beam component BC1 and the second beam component BC2 are tilted, spanning a tilt angle $\alpha+$.

A spatial modulation of period $\Lambda$ of a plane wave, e.g. a plane wave hitting a grating, is reproduced after a certain distance behind the grating. The distance is called the Talbot-length $L_{Talbot}$, and the repeated images are called self images or Talbot images. The intensity distribution at any point behind the grating is called diffraction pattern. In FIG. 1 two diffraction pattern DP1 and DP2 of a first order are shown. Furthermore, at half the Talbot length, a self-image also occurs, but phase-shifted by half a period (the physical meaning of this is that it is laterally shifted by half the width of the grating period). At smaller regular fractions of the Talbot length, sub-images can also be observed.

If the grating is a pi-phase grating, then after odd multiples of $L_{Talbot}/16$ an interference pattern is present, i.e. and intensity modulation with twice the spatial frequency of the grating. A so-called pi/2 phase grating may also be considered, but then the interesting interference pattern occurs at a different distance and a different spatial frequency.

At the Talbot distance, a wavefront with just a phase modulation is present. In the fractional distances, the phase modulation has been transformed into an intensity modulation which is exploited. The first diffraction pattern DP1 and the second diffraction pattern DP2 each comprise maxima MA and minima MI of intensity. The second grating may be moveable along a line d from one maximum MA to one minimum MI of intensity of the first diffraction pattern DP1 or of the second diffraction pattern DP2.

Figure 2:
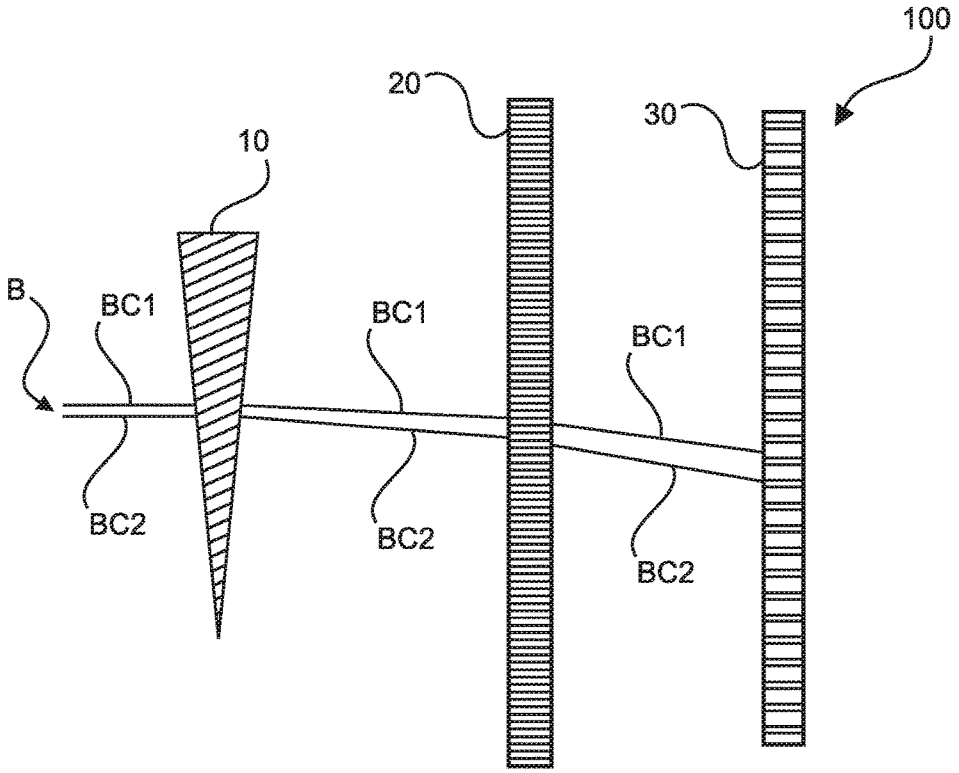
FIG. 2 shows a schematic diagram of a grating arrangement for spectral filtering of an X-ray beam according to an exemplary embodiment of the invention.

FIG. 2 shows a schematic diagram of a grating arrangement for spectral filtering of an X-ray beam according to an exemplary embodiment of the invention.

FIG. 2 shows an illustration of the Talbot filtration effect for spectral filtering of an X-ray beam B. Two quasi-monochromatic components BC1 and BC2 of the X-ray beam B are singled out for illustration purposes. These two quasi-monochromatic components BC1 and BC2 are basically parallel to each other before they hit the dispersive element 10. The higher energy component BC1 is diffracted less than the low energy component BC2 by the dispersive element 10 and the interference fringes formed by means of the first grating 10 at the location of the second grating 30 are shifted with respect to one another.

In the X-ray regime, the shift of the fringes of the first diffraction pattern DP1 and the second diffraction pattern DP2 from their reference position (no prism present) is inversely proportional to the square X-ray energy. The phase itself goes inversely with energy, the phase of the interference pattern with $1/E^2$. This effect can be used in conjunction with a certain analyzer grating to single out one component and block the other.

According to one embodiment, a grating arrangement 100 for spectral filtering of an X-ray beam B comprises a dispersive element 10, a first grating 20, and a second grating 30.

The dispersive element 10 is configured to diffract the X-ray beam B into a first beam component BC1 comprising a first direction D1 and a second beam component comprising BC2 a second direction D2, tilted with respect to the first direction.

The first grating 20 is configured to generate a first diffraction pattern DP1 of the first beam component BC1 and a second diffraction pattern DP2 of the second beam component BC2, the second diffraction pattern DP2 shifted with respect to the first diffraction patter DP1; and The second grating 30 comprises at least one opening 31 which is aligned along a line d from a maximum MA to a minimum MI of intensity of the first diffraction pattern DP1 or of the second diffraction pattern DP2.

Optionally, according to an embodiment, the first grating 20 and/or the second grating 30 is configured to be movable in such way that the at least one opening 31 is moveable along the line d from the maximum MA to the minimum MI of intensity of the first diffraction pattern DP1 or of the second diffraction pattern DP2.

Figure 3:
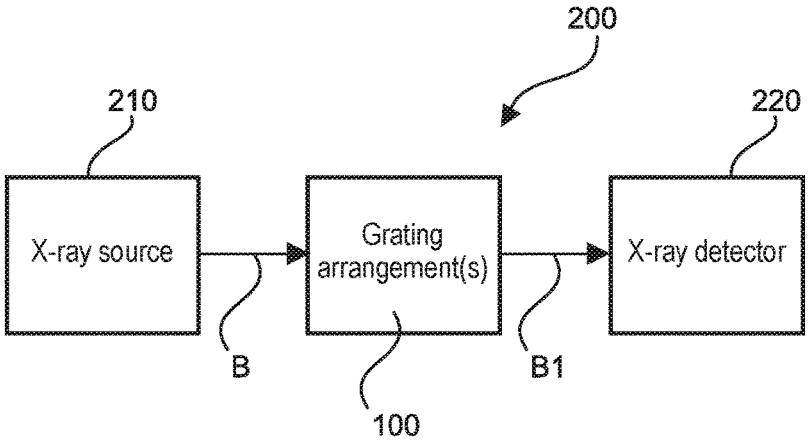
FIG. 3 shows a schematic diagram of an X-ray system according to an exemplary embodiment of the invention.

FIG. 3 shows a schematic diagram of an X-ray system according to an exemplary embodiment of the invention.

The X-ray system may comprise an X-ray source 210, which is adapted to generate a polychromatic spectrum of X-rays, i.e. an X-ray beam B, a detector 220 and at least one grating arrangement 100.

The grating arrangement 100 can be applied in a multitude of fields where the requirements of the filtration of X-ray spectra goes beyond what is traditionally achievable using the insertion of a certain material and using attenuation according to the linear attenuation coefficient of that material. Typical application might be medical imaging, as for instance, mammography, interventional imaging, X-ray computed tomography (X-ray CT), producing topographic images, non-destructive testing, X-ray microscopy, biomedical imaging and many more.

The grating arrangement 100 may filter the X-ray beam B into a filtered X-ray beam B1 comprising a modified spectrum.

Figure 4:
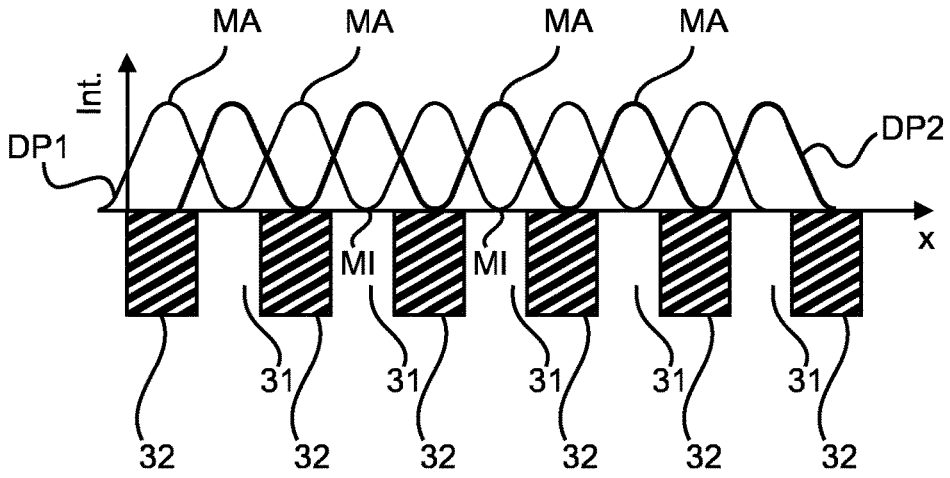
FIG. 4 shows a schematic diagram of a grating arrangement for spectral filtering of an X-ray beam according to an exemplary embodiment of the invention.

FIG. 4 shows a schematic diagram of a grating arrangement for spectral filtering of an X-ray beam according to an exemplary embodiment of the invention.

FIG. 4 shows relative shifts of the interference patters of two quasi-monochromatic components corresponding to different energies in the X-ray wave field.

In the lower part of FIG. 4, the second grating 30 is shown. The second grating 30 may comprise multiple openings 31 and bars 32. The bars 32 and the openings 31 of the second grating 30 may form and be arranged as a periodic structure.

The high energy component corresponding to the second diffraction pattern DP2 is transmitted when the openings 31 of the second grating 30 are brought in alignment with the maxima MA of the intensity for the high energy component.

Contrary, the low energy component corresponding to the first diffraction pattern DP1 is transmitted when the openings 31 of the second grating 30 are brought in alignment with the maxima of the intensity for the low energy component.

In the upper part of FIG. 4, a lateral intensity distribution is shown. The Y-axis shows the intensity of the high and low energy component, the X-Axis denotes the place x. The two diffraction pattern DP1 and DP2 are visualized by two functions comprising a sinusoidal form.

Figure 5:
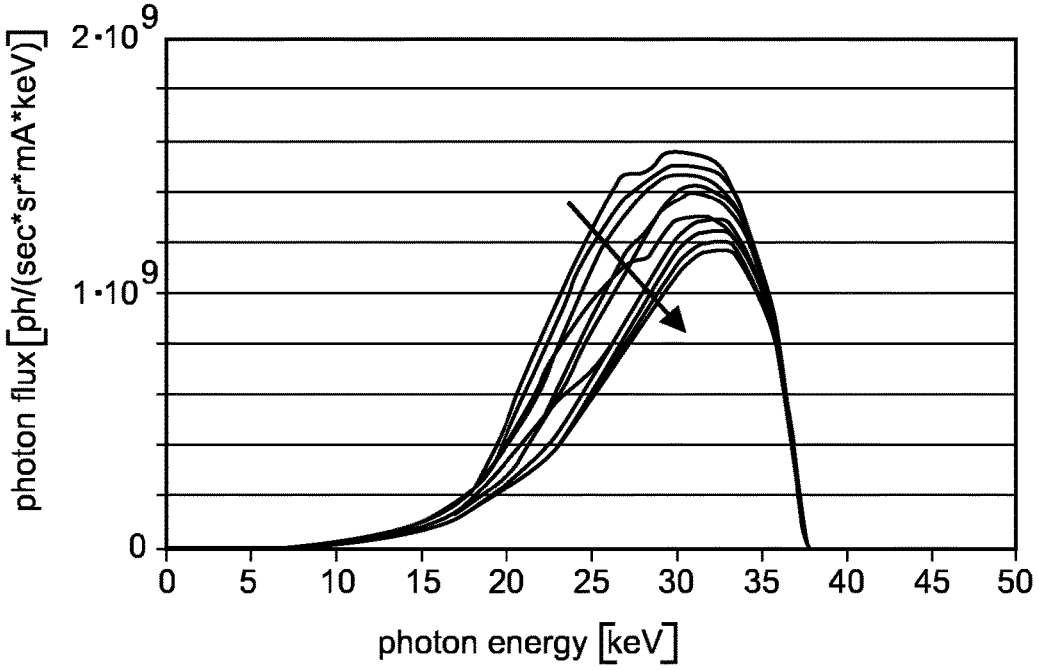
FIG. 5 shows a set of spectra of the spectral filtered X-ray beam for explaining the invention.

FIG. 5 shows a set of spectra of the spectral filtered X-ray beam for explaining the invention. The experimental realization of the spectral Talbot filtration effect is presented in FIG. 5. For this experiment a conventional X-ray tube spectrum with the tube voltage set to 38 kV was used.

FIG. 5 shows a family of curves as a set of spectra, each spectrum of which is given by a spectrum recorded at a different position of the second grating 30. The spectra shown were measured with a high-purity germanium detectors (HPGe) and feature energy resolution better than 1 keV. The modulations in the spectrum are due to the described effect illustrated in the figure description corresponding to FIG. 4, i.e. that the various monochromatic components in the spectrum get more or less blocked by the second grating 30 depending on the relative position of the fringes to the absorbing grating structures. The black arrow indicates the effect of moving the second grating 30 along a line d from a maximum MA to a minimum MI of intensity of the first or the second diffraction pattern.

The efficiency of the filtration to radiation of a given energy depends strongly on the visibility of the fringes at that energy. Hence, it is desirable to have as high a visibility as possible realized in the gratings interferometer.

Figure 6A:
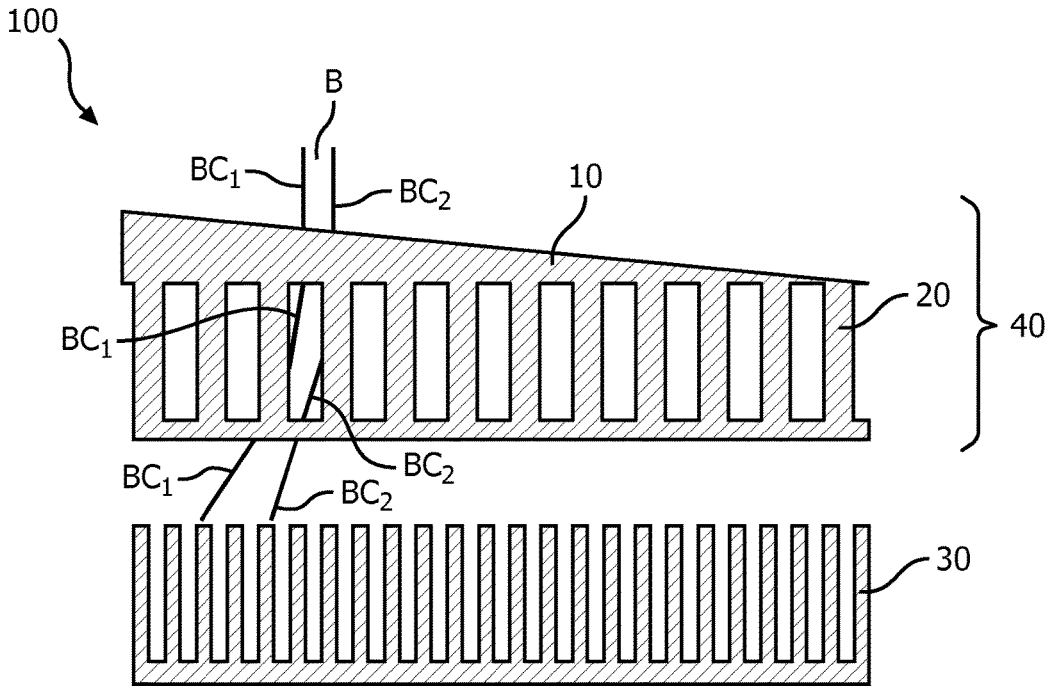
FIGS. 6A, 6B and 6C show schematic diagrams of grating arrangements according to exemplary embodiments of the invention wherein the dispersive element and the first grating are integrated into a dispersive grating.
Figure 6B:
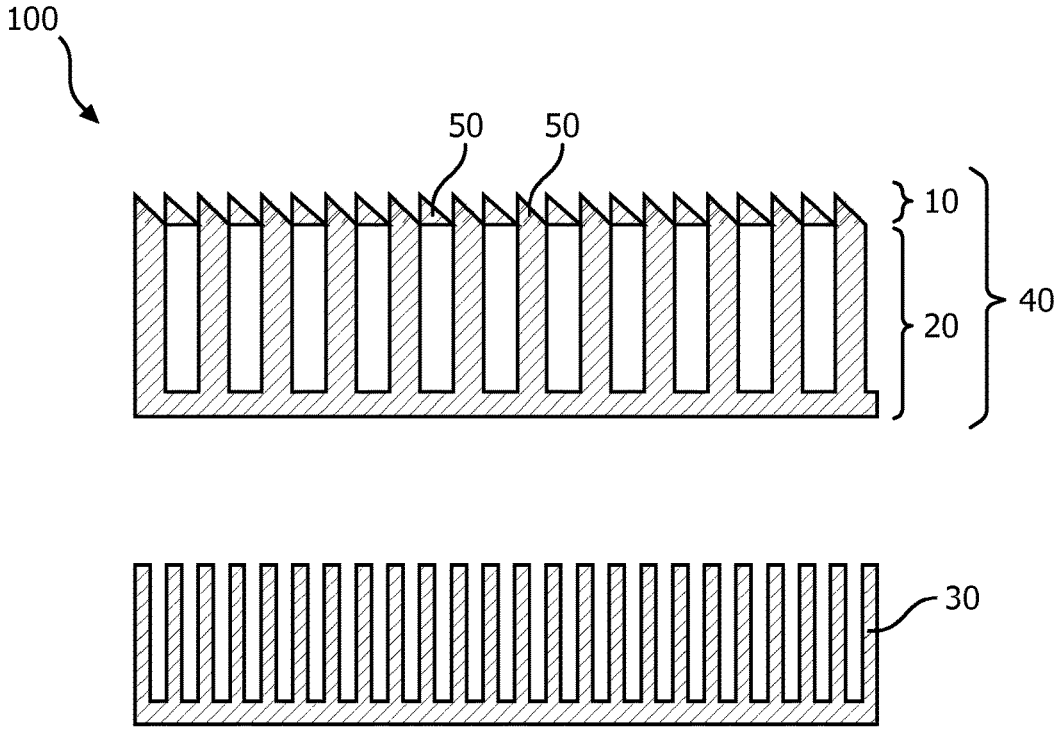
Figure 6C:
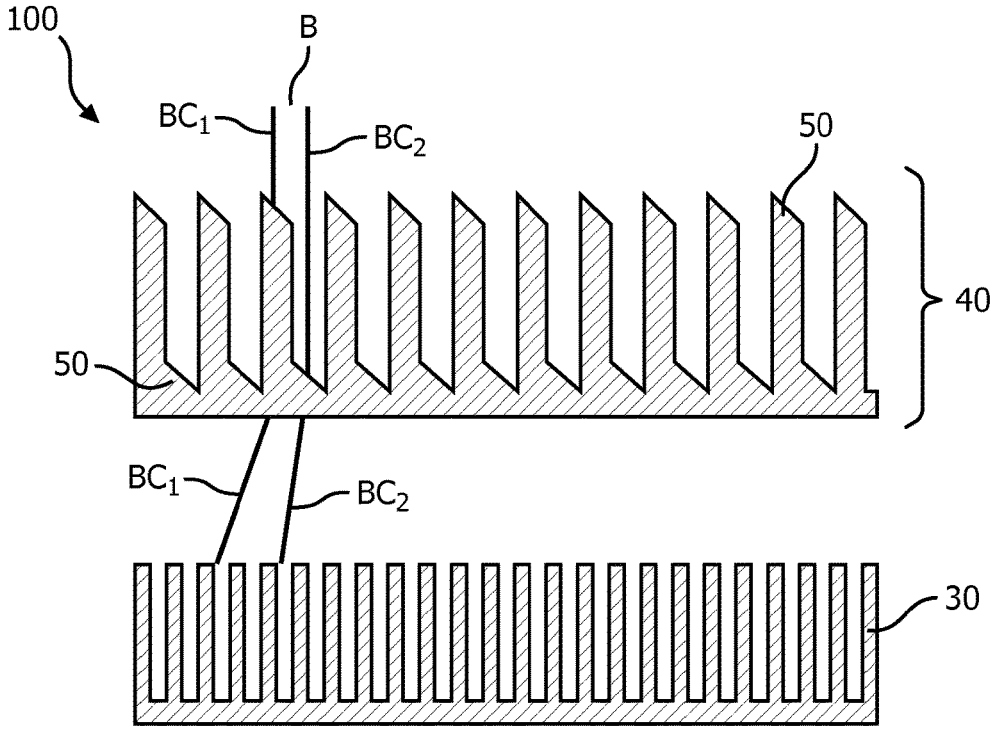

FIGS. 6A, 6B and 6C show schematic diagrams of grating arrangements according to exemplary embodiments of the invention wherein the dispersive element is mounted on top of the first grating 20.

FIG. 6A shows a schematic diagram of a grating arrangement 100 wherein the dispersive element 10, along the direction of the X-ray beam B, is mounted on top of the first grating 20, such as to constitute a dispersive grating 40. The dispersive grating 40, which jointly incorporates the dispersive element 10 and the first grating 20, is configured for diffracting the X-ray beam B into the first beam component BC1 comprising the first direction D1 and the second beam component BC2 comprising the second direction D2, wherein the second direction is being tilted with respect to the first direction. The dispersive grating 40 is furthermore arranged for generating the first diffraction pattern (not shown) of the first beam component and the second diffraction pattern (not shown) of the second beam component, wherein the second diffraction pattern is being shifted with respect to the first diffraction pattern. In this specific example, dispersive element 10 is a triangular prism. Optionally, according to a specific embodiment, the grating arrangement 100 furthermore comprises a second grating 30.

Similar to FIG. 6A, FIG. 6B shows a schematic diagram of a grating arrangement 100 wherein the dispersive element 10, along the direction of the X-ray beam B, is mounted on top of the first grating 20 such as to constitute a dispersive grating 40. However, in this specific example, dispersive element 10 comprises a periodic structure of prisms 50, wherein each of such prisms is configured for diffracting the X-ray beam B into the first beam component BC1 comprising a first direction D1 and the second beam component comprising BC2 the second direction D2, and wherein said second direction is tilted with respect to the first direction. In this specific example, the periodic structures of dispersive elements 10 and first grating 20 have periods Td and Tg, respectively, wherein period Td equals half of Period Tg. Please note the slopes of the prisms 50 not necessarily equal that of dispersive element 10 as comprised in the exemplary embodiment of the invention depicted in FIG. 6A. Alternatively, according to another exemplary embodiment of the invention, the periodic structure of prisms 50 may be mounted, along the direction of the X-ray beam B, at the bottom of the first grating 20 such as to constitute a dispersive grating 40. Optionally, according to another exemplary embodiment of the invention, the grating arrangement 100 furthermore comprises a second grating 30.

Similar to FIG. 6B, FIG. 6C shows a schematic diagram of a grating arrangement 100 wherein the dispersive element 10, along the direction of the X-ray beam B, is mounted on top of the first grating 20 such as to constitute a dispersive grating 40, and wherein the dispersive element 10 comprises a periodic structure of prisms 50. However, in this specific example, the dispersive element 10 and the first grating 20 are integrated into the dispersive grating 40, wherein the prisms 50 (which are, for the purpose of explanation, identical to those of the specific example as displayed in FIG. 6B) are super-imposed on the periodic structure of the first grating 20. Consequently, contrary to the specific example as depicted in FIG. 6B, in this exemplary embodiment of the invention, no gaps are present between the prisms 50 and the minima of the periodic structure. Similar to the exemplary embodiment of the invention as displayed in FIG. 6B, period Td equals half of Period Tg. Optionally, according to a specific embodiment, the grating arrangement 100 furthermore comprises a second grating 30.

Figure 7A:
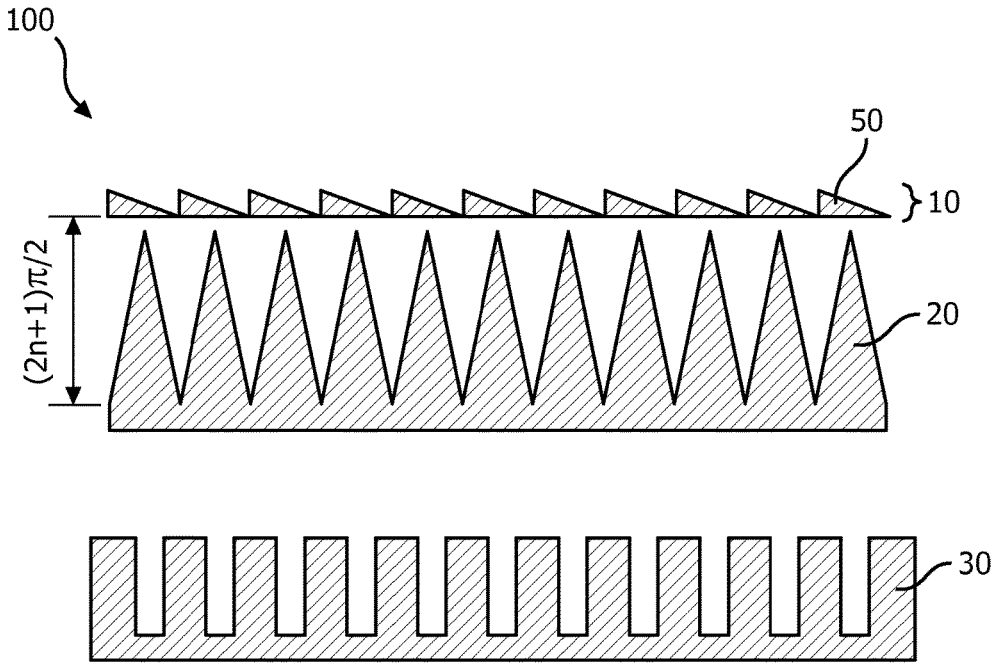
FIGS. 7A and 7B show schematic diagrams of grating arrangements according to exemplary embodiments of the invention wherein the first grating is a microlensing grating.
Figure 7B:
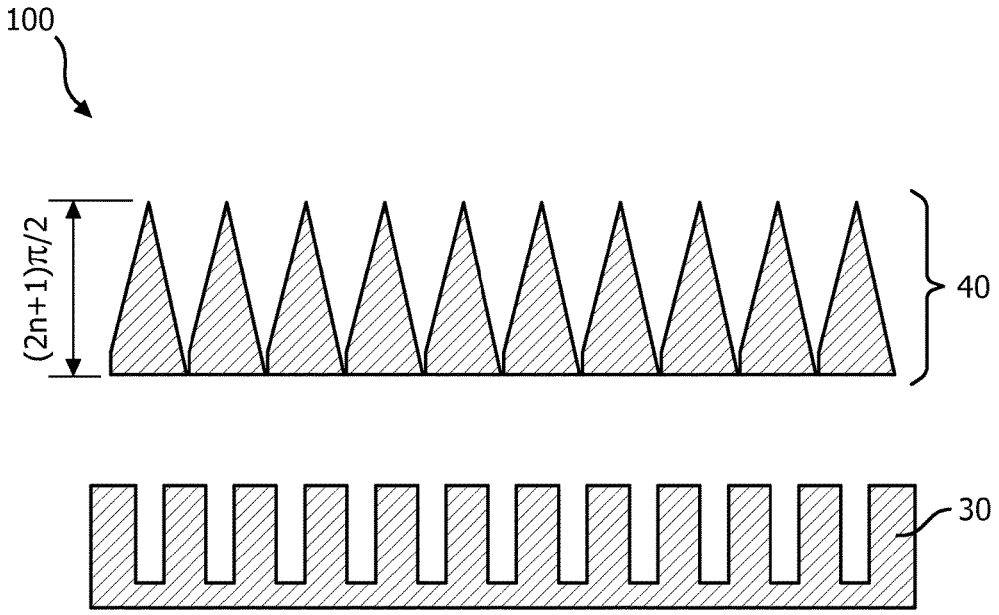

FIGS. 7A and 7B show schematic diagrams of grating arrangements according to exemplary embodiments of the invention wherein the first grating is a microlensing grating.

FIG. 7A shows a schematic diagram of a grating arrangement 100 comprising a dispersive element 10 and a first grating 20 being a micro lensing grating. In this specific example, the microlensing grating is constituted by a periodic structure of triangular prisms. Alternatively, according to another exemplary embodiment of the invention, the micro lensing grating may be constituted by semi-circular or parabolic prisms. In this specific example, the microlensing grating has a height equal to (2n+1)*pi/2, wherein n denotes the amount of fringes as comprised in the microlensing grating. In this specific embodiment the dispersive element 10 comprises a periodic structure of prisms 50. In this specific example, the periodic structure of the dispersive element 10 and the first grating 20 have periods Td and Tg, respectively, wherein period Td equals period Tg. Optionally, according to a specific embodiment of the invention, the dispersive element 10 may be mounted, along the direction of X-ray beam B, on top of the first grating 20 such as to constitute a dispersive grating. Alternatively, according to another exemplary embodiment of the invention, the dispersive element 10 may be mounted, along the direction of X-ray beam B, at the bottom of the first grating 20 such as to constitute a dispersive grating. Optionally, according to another specific embodiment of the invention, the grating arrangement 100 furthermore comprises a second grating 30. Owing to the first grating 20 being a microlensing grating, the duty cycle of the second grating 30 may be reduced compared to the exemplary embodiments of the invention as displayed in FIGS. 6A, 6B and 6C.

Similar to FIG. 7A, FIG. 7B shows a schematic diagram of a grating arrangement 100 comprising a dispersive element 10 and a first grating 20 being a microlensing grating. However, in this specific example the prisms 50 (which are, for the purpose of explanation, identical to those of the specific example as displayed in FIG. 6B) are superimposed on the periodic structure of the microlensing grating. Consequently, contrary to the specific example as depicted in FIG. 7A, in this exemplary embodiment of the invention, no gaps are present between the prisms 50 and the microlensing grating. Hence, in this exemplary embodiment of the invention, the dispersive element 10 and the first grating 20 being a micro lensing grating are integrated into a dispersive grating 40. The micro lensing grating has a height equal to (2n+1)*pi/2, wherein n denotes the amount of fringes as comprised in the micro lensing grating. Similar to the exemplary embodiment of the invention as displayed in FIG. 7A, period Td equals period Tg.

Figure 8:
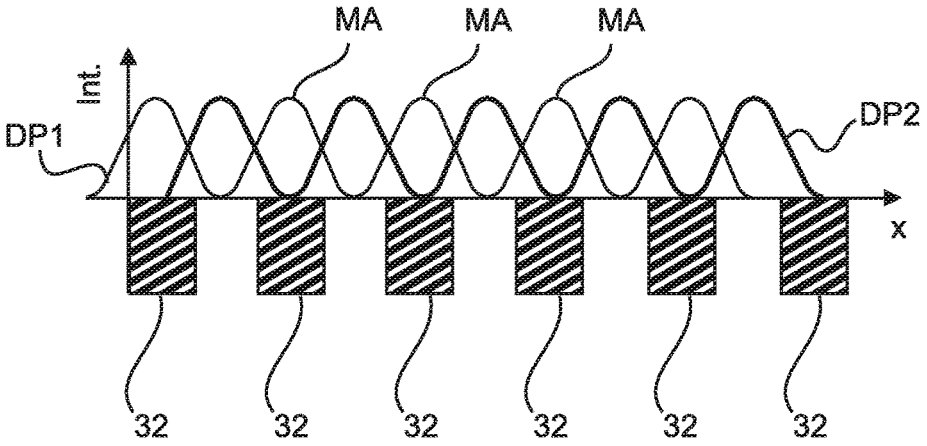
FIG. 8 shows a schematic diagram of a grating arrangement for spectral filtering of an X-ray beam according to an exemplary embodiment of the invention.

FIG. 8 shows a schematic diagram of a grating arrangement for spectral filtering of an X-ray beam according to an exemplary embodiment of the invention.

The spatial separation between the various fringes, corresponding to different mono-chromatic components in the original wave-field, increases with the refractive index of the prism and with the prism angle. It is determined by the total phase-gradient imprinted onto the wave field by the prism.

The duty cycle of both the first grating 20 and the second grating 30 can be tuned in such a way as to obtain interference fringes with higher visibility. In this way spectral separation or selection by splitting in the spatial domain is even more efficient when used together with appropriate second gratings 30 with a pitch adapted to the particular needs of the application. Much more complex masks can be designed so that pre-selected mono-chromatic components can be singled out arbitrarily. Shifting the second gratings 30 can easily also be used to quickly modify the spectrum with only a tiny lateral displacement, easily realized with, i.e. piezo-electric actuators.

For very high gradients realized, e.g. by a very steep grating (close to 180 degree) or a very electron-dense material, the energy dispersion might be so large that energies will "wrap", meaning that fringes corresponding to distinct energies will again align. This can lead to quasi-periodic oscillation of the transmittance of the filter as a function of energy (leading to "comb-like" spectra), a feature very difficult to obtain by other means for X-rays. These combs could be shifted in energy via a translation of the second grating 30.

The comb structure can of course be easily removed by cascading two or more of the proposed filters with different prisms. To avoid the attenuation gradient cascading could also help by putting two identical systems behind one another with the only difference of flipping the prism in one case.

The further elements and reference signs of FIG. 8 are already explained and described in the description corresponding to FIG. 4. Therefore, a repeated description of these elements and reference signs is omitted.

Figure 9:
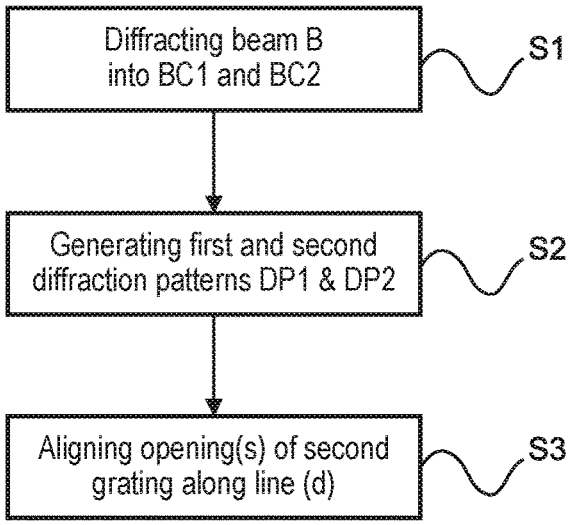
FIG. 9 shows a flowchart diagram of a method for spectral filtering of an X-ray beam according to an exemplary embodiment of the invention.

FIG. 9 shows a flowchart diagram of a method for spectral filtering of an X-ray beam according to an exemplary embodiment of the invention.

The method for spectral filtering of an X-ray beam B may comprise the following steps:

As a first step of the method, diffracting S1 the X-ray beam B into a first beam component BC1 comprising a first direction D1 and a second beam component BC2 comprising a second direction D2 tilted with respect to the first direction D1 by means of a dispersive element 10 is performed.

As a second step of the method, generating S2 a first diffraction pattern DP1 of the first beam component BC1 and a second diffraction pattern DP2 of the second beam component BC2 by means of a first grating 20 is conducted, the second diffraction pattern DP2 shifted with respect to the first diffraction pattern DP.

As a third step of the method, aligning S3 a second grating 30 with at least one opening 31, in such a way that the at least one opening 31 is aligned along a line d from a maximum MA to a minimum MI of an intensity of the first diffraction pattern DP1 or of the second diffraction pattern DP2 is conducted.

Optionally, according to an embodiment of the invention, in a further step of the method, moving S3 the first grating 20 and/or the second grating 30 with at least one opening 31 in such way is conducted, that the at least one opening 31 is moved moveable along a line d from a maximum MA to a minimum MI of an intensity of the first diffraction pattern DP1 or of the second diffraction pattern DP2.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practicing the claimed invention, from a study of the drawings, the disclosure, and the appended claims.

In the claims, the word "comprising" does not exclude other elements or steps, and the indefinite article "a" or "an" does not exclude a plurality. A single processor or controller or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

LIST OF REFERENCE SIGNS

10 dispersive element
20 first grating
30 second grating
40 dispersive grating
50 prism
31 opening
32 bar
100 grating arrangement
200 X-ray system
210 X-ray source
220 X-ray detector
B X-ray beam
B1 filtered X-ray beam
BC1 first beam component
BC2 second beam component
α+ tilt angle
d line
D1 first direction
D2 second direction
DP1 first diffraction pattern
DP1-1 diffraction pattern of higher order
DP2 second diffraction pattern
MA maximum
MI minimum
Td period of the dispersive element
Tg period of the first grating

The invention claimed is:

1. A grating arrangement for spectral filtering of an X-ray beam (B), comprising:

a dispersive element comprising a prism configured to diffract the X-ray beam (B) into a first beam component (BC1) comprising a first direction (D1) and a second beam component (BC2) comprising a second direction (D2), tilted with respect to the first direction;

a first grating configured to generate a first diffraction pattern (DP1) of the first beam component (BC1) and a second diffraction pattern (DP2) of the second beam component (BC2), the second diffraction pattern (DP2) shifted with respect to the first diffraction pattern (DP1); and a second grating comprising at least one opening which is aligned along a line (d) from a maximum (MA) to a minimum (MI) of intensity of the first diffraction pattern (DP1) or of the second diffraction pattern (DP2).

2. The grating arrangement according to claim 1, wherein the first direction (D1) and the second direction (D2) are tilted, spanning a tilt angle (α+).

3. The grating arrangement according to claim 1, wherein the first grating is configured to shift the second diffraction pattern (DP2) with respect to the first diffraction pattern (DP1) along a direction corresponding to the direction of the line (d).

4. The grating arrangement according to claim 1, wherein at least one of the first beam component (BC1) and the second beam component (BC2) comprises quasi-monochromatic X-ray radiation.

5. The grating arrangement according to claim 1, wherein the first grating is configured to generate the first diffraction pattern (DP1) of the first beam component (BC1) and the second diffraction pattern (DP2) of the second beam component (BC2) as a near-field diffraction effect.

6. The grating arrangement according to claim 1, wherein the second diffraction pattern (DP2) is shifted with respect to the first diffraction pattern (DP1) by means of an energy-dependent lateral shift.

7. The grating arrangement according to claim 1, wherein at least one of the first grating and the second grating comprises a periodic structure.

8. The grating arrangement according to claim 1, wherein at least one of the first grating and the second grating is configured to be movable in such way that the at least one opening is moveable along the line (d) from the maximum (MA) to the minimum (MI) of intensity of the first diffraction pattern (DP1) or of the second diffraction pattern (DP2).

9. The grating arrangement according to claim 1, wherein the dispersive element and the first grating are integrated such as to constitute a dispersive grating.

10. The grating arrangement according to claim 1, wherein the dispersive element comprises a periodic structure of prisms, wherein each of said prisms is configured for diffracting the X-ray beam (B) into the first beam component (BC1) comprising the first direction (D1) and the second beam component (BC2) comprising the second direction (D2), and wherein said second direction is tilted with respect to the first direction.

11. The grating arrangement according to claim 1, wherein the first grating is a microlensing grating.

12. An X-ray system, with an X-ray source, which is adapted to generate a polychromatic spectrum of X-rays, a detector and at least one grating system according to claim 1.

13. The grating arrangement of claim 1, further comprising a processor and an actuator and configured for, via said processor, controlling said actuator to align said second grating so as to perform the aligning of said at least one opening along said line (d).

14. A method for spectral filtering of an X-ray beam (B), comprising the steps of:

diffracting (S1) the X-ray beam (B) into a first beam component (BC1) comprising a first direction (D1) and a second beam component (BC2) comprising a second direction (D2) tilted with respect to the first direction (D1) by means of a dispersive element comprising a prism;

generating (S2) a first diffraction pattern (DP1) of the first beam component (BC1) and a second diffraction pattern (DP2) of the second beam component (BC2) by means of a first grating, the second diffraction pattern (DP2) shifted with respect to the first diffraction pattern (DP1); and aligning (S3) a second grating with at least one opening in such way that the at least one opening is aligned along a line (d) from a maximum (MA) to a minimum (MI) of an intensity of the first diffraction pattern (DP1) or of the second diffraction pattern (DP2).

15. A non-transitory computer-readable medium, on which is stored a computer program for spectral filtering of X-ray beam, said computer program including instructions executable by a processor for carrying out a plurality of acts, from among said plurality there being the acts of;

diffracting (S1) the X-ray beam (B) into a first beam component (BC1) comprising a first direction (D1) and a second beam component (BC2) comprising a second direction (D2) tilted with respect to the first direction (D1) by means of a dispersive elemant comprising a prism;

generating (S2) a first diffraction pattern (DP1) of the first beam component (BC1) and a second diffraction pattern (DP2) of the second beam component (BC2) by means of a first grating, the second diffraction pattern (DP2) shifted with respect to the first diffraction pattern (DP1); and aligning (S3) a second grating with at least one opening in such way that the at least one opening is aligned along a line (d) from a maximum (MA) to a minimum (MI) of an intensity of the first diffraction pattern (DP1) or of the second diffraction pattern (DP2).

* * * * *